US009198488B2

(12) United States Patent
Pronzati et al.

(10) Patent No.: US 9,198,488 B2
(45) Date of Patent: Dec. 1, 2015

(54) TELESCOPIC STICK FOLDABLE IN TWO PORTIONS

(75) Inventors: Marco Pronzati, Vanzago (IT); Lorenzo Pronzati, Milan (IT)

(73) Assignee: GIPRON GIUSEPPE PRONZATI S.R.L., Vanzago (Milan) (IT)

( * ) Notice: Subject to any disclaimer, the term of this patent is extended or adjusted under 35 U.S.C. 154(b) by 0 days.

(21) Appl. No.: 14/236,923

(22) PCT Filed: Jul. 31, 2012

(86) PCT No.: PCT/EP2012/064968

§ 371 (c)(1), (2), (4) Date: Feb. 4, 2014

(87) PCT Pub. No.: WO2013/020861

PCT Pub. Date: Feb. 14, 2013

(65) Prior Publication Data

US 2014/0216510 A1 Aug. 7, 2014

(30) Foreign Application Priority Data

Aug. 5, 2011 (IT) ..... MI20110270 U

(51) Int. Cl.
*A45B 9/00* (2006.01)
*A63C 11/22* (2006.01)

(52) U.S. Cl.
CPC ..... *A45B 9/00* (2013.01); *A63C 11/221* (2013.01); *A45B 2009/007* (2013.01); *A63C 2203/10* (2013.01)

(58) Field of Classification Search
CPC .... A45B 9/00; A45B 2009/007; A45B 19/04; A45B 3/12; A63C 11/221; A63C 11/222; A63C 11/22; A63C 2203/10
USPC ..... 135/65, 74, 75; 280/819, 823; 403/109.1–109.3, 109.5, 373
See application file for complete search history.

(56) References Cited

U.S. PATENT DOCUMENTS 2,705,015 A 3/1955 Langlais
3,635,233 A * 1/1972 Robertson ..... 135/71

(Continued)

FOREIGN PATENT DOCUMENTS

| | | |
|---|---|---|
| EP | 0 641 578 | 3/1995 |
| EP | 0 822 346 | 2/1998 |
| WO | 92/11069 | 7/1992 |

OTHER PUBLICATIONS

International Search Report dated Nov. 15, 2012, in corresponding PCT application.

*Primary Examiner* — Winnie Yip
(74) *Attorney, Agent, or Firm* — Young & Thompson

(57) ABSTRACT

A telescopic stick foldable in two portions (100), to be used for hiking, downhill skiing, cross country skiing, is made up of at least four tubular portions: an upper telescopic tubular part (200) provided with a grip (60), a first intermediate telescopic tubular part (300), a second intermediate telescopic tubular part (400), the telescopic parts sliding one in the other and fixable in position by locking elements, and a lower tubular part (500) terminating with a pointed end (1) connected to the second intermediate part adjacent to it. The lower tubular part (500) is restrained to the remaining parts by a rope (2) which traverses at least the second intermediate part (400), so that the stick can be folded in two parts, bringing the telescopic parts into a position of minimum extension and folding the lower part (500) on the others after having released it from the adjacent intermediate part.

12 Claims, 2 Drawing Sheets

(56) References Cited

U.S. PATENT DOCUMENTS

| | | | | | |
|---|---|---|---|---|---|
| 3,730,544 | A * | 5/1973 | Hyman | 280/819 |
| 3,963,037 | A * | 6/1976 | Clark | 135/65 |
| 4,869,280 | A * | 9/1989 | Ewing | 135/69 |
| 5,441,307 | A * | 8/1995 | Quintana et al. | 280/823 |
| 7,201,401 | B1 * | 4/2007 | Friedman | 280/823 |
| 2003/0047203 | A1 * | 3/2003 | Lah | 135/114 |
| 2007/0108756 | A1 * | 5/2007 | Laakso et al. | 280/823 |
| 2008/0121260 | A1 * | 5/2008 | Stephens et al. | 135/75 |
| 2010/0170547 | A1 * | 7/2010 | Pietrzak et al. | 135/75 |
| 2010/0200032 | A1 * | 8/2010 | Lee | 135/74 |

* cited by examiner

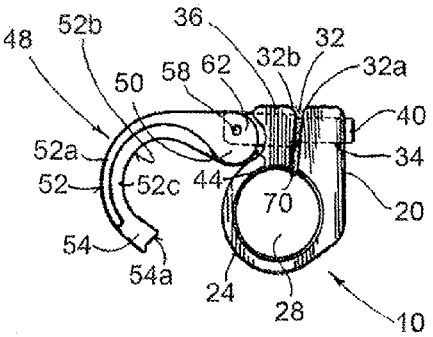
FIG. 4
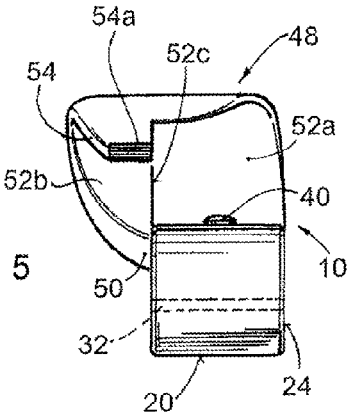
FIG. 5
FIG. 6
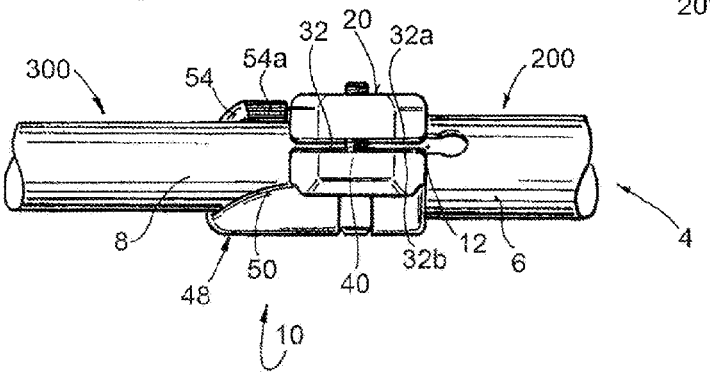
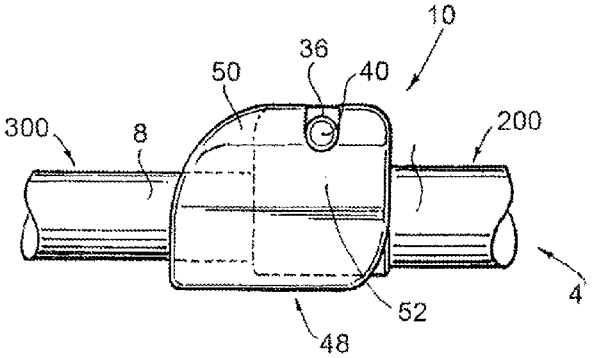
FIG.7

TELESCOPIC STICK FOLDABLE IN TWO PORTIONS

BACKGROUND OF THE INVENTION

The present invention relates to the field of compact sticks in general, in particular compact walking sticks used both in sports, especially hiking, downhill skiing, cross country skiing, Nordic walking, and the like, and in orthopaedics. Herein below specific reference will be made to hiking sticks for simplicity of description without any intention of limitation to such use.

Compact trekking sticks of the "foldable" type and of the "telescopic" type are widely available on the market thanks to the fact that, when closed or folded, they assume a reduced overall dimension so as to be easily transported even in a backpack. These compact sticks are also very popular due to the fact that they can be rapidly assembled, providing a hiking stick as resistant as any other stick formed by a single piece.

Compact sticks of the "foldable" type are formed by at least three or more hollow tubular portions of which an upper one comprising a grip in soft material, a final portion provided with a pointed end, and an intermediate portion connected between the two. These portions are connected one to the other by means of a rope placed inside of the portions of the stick which holds them together and makes this stick foldable in three or more parts.

However, in order to have a smaller overall length dimension, these foldable sticks should be formed by as many portions as possible, for example four or five: for example, sticks foldable into four parts have a very small overall length dimension, generally around about 32 cm. This, however, involves an increase in the overall width dimension of the folded stick.

This problem is instead not found in the telescopic sticks formed by two, three or four hollow tubular portions, similarly to foldable sticks which are however telescopic and connected one to the other by means of locking devices suitable for regulating the extension of one portion in relation to the other. These sticks are also assembled rapidly and provide a hiking stick as resistant as any other stick formed by a single piece. Moreover they have the advantage of having, when closed, a reduced overall width dimension (volume) in that equal to that of a single portion of the stick and far smaller than foldable sticks.

However, these telescopic sticks exhibit an overall length dimension such that they only can be stored in capacious backpacks or bags, for example telescopic sticks with three sections generally have an overall length dimension of the order of 60 cm.

BRIEF SUMMARY OF THE INVENTION

The main object of the present invention is, therefore, to provide a stick having a reduced overall dimension in both length and width, even smaller than known foldable and telescopic sticks, able to eliminate the disadvantages described above with reference to the state of the art.

In particular, one object of the invention is to provide such a stick which can be transported in a conventional backpack for hiking, can be rapidly assembled and, once assembled, can be a walking stick as resistant as any other stick formed by a single piece.

These and other objects, which will be made clearer herein below, are achieved by the stick in accordance with the invention with the features listed in the appended independent claim 1.

Advantageous aspects of the invention are disclosed by the dependent claims.

According to the invention a telescopic stick which is foldable in two parts is provided, consisting of at least four tubular portions of which three telescopic in which the fourth portion, relating to the end part of the stick, is held together with the other portions by a rope placed inside these portions.

In particular, the stick is formed by

- three or more telescopic tubular parts, of which an upper part provided with a grip, and two intermediate tubular parts, connected one to the other via two locking elements for telescopic rods, said parts being sliding one in the other;
- a lower part provided with a tip, forcibly connectable to the telescopic tubular part adjacent to it, and having the upper end integral with the rope passing inside said telescopic parts.

Moreover an elastic band is provided at said grip, suitable for being arranged around the folded parts of the stick in order to keep them together and compact when the stick is in a non-assembled condition.

Thanks to the combined use of at least three telescopic portions and of a rope which connects said three telescopic parts to the lower part of the stick it is possible to obtain the folding of said lower part with respect to the telescopic parts thus resulting in a stick foldable in two parts.

BRIEF DESCRIPTION OF THE DRAWINGS

Further features of the invention will be made clearer by the following detailed description, referred to one of its embodiments purely by way of a non-limiting example illustrated in the accompanying drawings, in which:

FIG. 4 is a front view of one of the locking devices for telescopic rods mounted on the stick of FIG. 1, illustrated in the open position and in the absence of the stick;

FIG. 5 is a side view of the locking device of FIG. 4 shown in the open position and in the absence of the stick;

FIG. 6 is a view from above of the device of FIG. 4, in position of closure and mounted on a stick;

FIG. 7 is a side view of the locking device of FIG. 4, in the closed position, mounted on a stick.

DETAILED DESCRIPTION OF THE PREFERRED EMBODIMENTS

Figure 1:
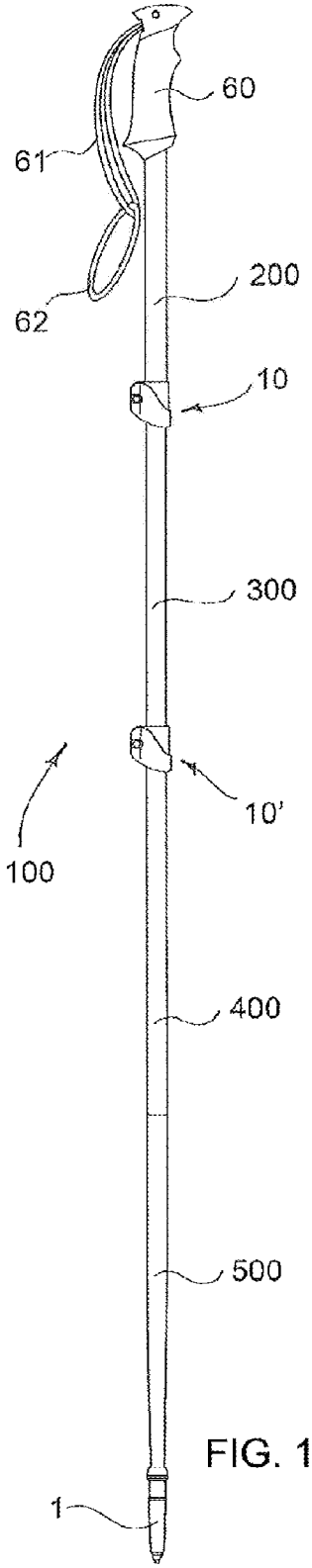
FIG. 1 is a front elevational view illustrating a first embodiment of a hiking stick, telescopic and foldable according to the invention, already assembled and ready for use.

In the accompanying drawings, identical or similar parts or components are denoted by the same reference numerals.

Referring to FIG. 1, a foldable hiking stick is shown and denoted overall by reference numeral 100. It is made up of an upper tubular part 200 provided with a grip 60, preferably soft, a first intermediate tubular part 300, a second intermediate tubular part 400, and a lower tubular part 500 terminating with a pointed end 1.

The upper tubular part 200 and the first intermediate part 300 on which it slides allow generally the regulation of the overall height of the stick according to the height of the user.

Positioned on the grip 60 is a strap 61, suitable for favouring a more secure grasping of the stick 100, and an elastic band 62, inserted in the strap, suitable for being arranged around the folded parts of the stick in order to keep them together and compact when the stick is in the folded condition as will be described in greater detail herein below.

The three upper 200, first intermediate 300 and second intermediate 400 tubular parts each have a substantially constant diameter along their entire length while the lower tubular part 500 has a diameter decreasing towards the pointed end 1, in a manner in itself known in the field of compact sticks.

The abovementioned tubular parts 200, 300, 400 which are telescopic are held together by two locking devices 10 and 10'. Additionally at least the two intermediate portions 300 and 400 and the lower tubular part 500 are connected by means of a rope 2 that traverses the second intermediate tubular part 400 and whose ends are restrained to the first intermediate tubular part 300 and to the lower tubular part 500.

The rope 2 can be also of the elastic type.

The length of the rope 2 between the restraint points is such as to firmly hold the lower part 500 assembled to the two intermediate parts 300, 400, when the latter parts are in the condition of maximum telescopic extension.

The locking device 10 has the purpose of blocking the sliding of the upper part 200 with a grip on the first intermediate part 300 thereby allowing the regulation of the total length of the stick 100.

The locking device 10' has the purpose of blocking the sliding of the second intermediate part 400 with respect to the first intermediate part 300, in the fully retracted position when the stick 100 is closed and folded (FIG. 2), or in the fully advanced position in the case of fully assembled stick (FIG. 1).

Figure 2:
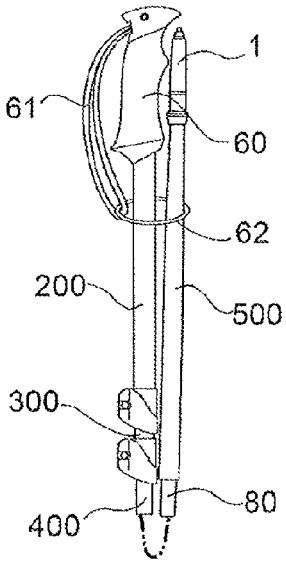
FIG. 2 is a front view illustrating the stick of FIG. 1 in folded form.

The rope 2 has the purpose of preventing the detachment of the lower part 500 from the remaining tubular parts 200, 300, 400 and at the same time of allowing this lower part 500 to be folded alongside said telescopic parts 200, 300, 400 as illustrated in FIG. 2.

This rope 2 has one of its ends inserted inside a shank 80 projecting from the head of the lower tubular part 500: in this way the rope 2 is restrained to the lower part 500 of the stick 100.

Said shank 80 has a diameter slightly smaller than that of the intermediate part 400 in such a way that the part 400 can be fitted over said shank 80 with slightly forced coupling, then fixing to said lower part 500.

The other end of the rope 2, which protrudes from the first intermediate portion 300, is restrained to the intermediate part 300 by means of a shank 3 sliding along the rope 2 which goes to abut in a hollow seat of a plug 4 mounted at the upper end of the first intermediate part 300. The plug 4, generally in plastic material, is forcibly inserted at the end of the first intermediate part 300 so as to be firmly locked to it, possibly also with the aid of a peg.

Said sliding shank 3 also has, on the rear part, a seat suitable for housing a knot 5 made at the end of said rope 2. Said knot 5 has the purpose of fixing the length of the rope 2 equal to the overall length of the two intermediate parts 300 and 400 wherein said rope is inserted.

Figure 3:
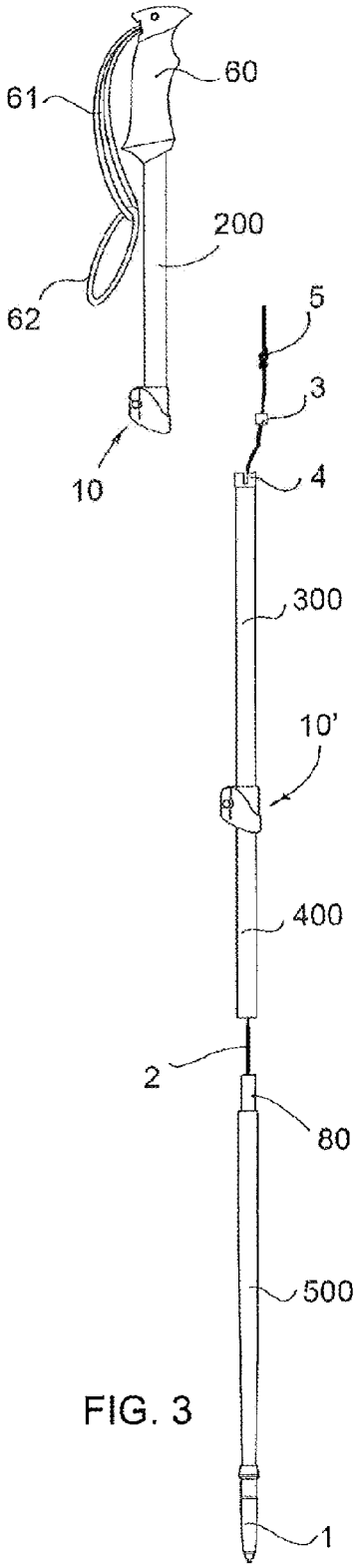
FIG. 3 is a view of the stick of FIG. 1, partially exploded.

The rope 2 also facilitates the assembly of the stick 100 since it allows the portion 500 to be kept in line with the telescopic parts 200, 300, 400: referring to FIG. 3, after having released the locking element 10', the more the second intermediate tubular part 400 slides downwards and along the rope 2, the more the rope 2 brings the lower portion 500 in line with the remaining telescopic parts, favouring the engaging of said part 400 over the shank 80 of the lower part 500.

Once the second intermediate part 400 has been forcibly detached from the lower portion 500 and moved away from it, making it re-enter telescopically the portion 300, the rope 2 can allow this lower part 500 to be folded next to and alongside the parts of the stick closed telescopically (FIG. 2) although said end part 500 is restrained to them.

Although a foldable stick made up of four portions is illustrated here, it is evident that the invention is not limited to the particular embodiment described, it being possible to apply it to sticks also made up of more than four parts.

The locking devices 10, 10', are devices known in the art of telescopic rods, for example with screwing or snap action, in particular like those described by EP 641 578 and by EP 822 346, herein incorporated in full by reference.

Particular advantageous is the use of the locking device described in EP 641 578 thanks to the extreme ease and speed of opening and closing of said device.

A brief description will be given herein below of the clamp locking device shown in EP 641 578, referring for simplicity to the locking element 10, it being fully understood that this description is also applicable to the locking element 10'.

Said device 10 is mounted at the zone of joining of two tubular elements sliding telescopically one in the other, 200, 300 described above. In this case the tubular part 200 within which the tubular part 300 slides, which has a diameter larger than the tubular part 300, will be provided with an elongated slot 12 (FIG. 6) at the end of connection with the tubular part 300. This slot 12 allows the end portion 6 of the tubular part 200 to decrease in diameter when a pressure is applied from the outside so that this end portion 6 can tighten around the end portion 8 of the tubular part 300, preventing its sliding inside the tubular part 200.

The external pressure is applied by the clamp locking device 10.

The clamp 10 comprises a cylindrical tubular element 20 formed by an annular side wall 24 which surrounds a cylindrical central hole 28 which extends longitudinally. In said central hole 28 the end portion 6 of said tubular part 200 of the stick is inserted. The tubular element 20 is provided with a slit 32 which extends along the entire length of the tubular element 20 to define side walls 32*a* and 32*b* opposite one to the other. The ends of these side walls 32*a* and 32*b* are thicker than the rest of the side wall 24 and include holes or apertures 34 and 36 coaxially arranged (FIGS. 4, 7). The coaxial holes 34 and 36 are provided to receive a pin 40 (FIG. 6).

On the outer side of the edge of the side wall 32*b* a cam surface 44 is located, formed in order to be slightly concave.

The tubular element 20 is constituted by a resilient material such as for example plastic, so that when a force is applied to the cam 44, the edge of the side wall 32*b* is pushed or folded towards the edge of the side wall 32*a*, in order to tighten the amplitude of the slit 32 and reduce the diameter of the central hole 28. This, in turn, makes it possible to tighten the tubular element 20 around the end portion 6 of the upper tubular part 200 thus causing this end portion 6 to grip the end portion 8 of the first intermediate part 300, securing the two tubular parts in a non-sliding fixed position.

The clamp 10 also includes a lever arm 48 rotatably attached to the tubular element 20 in order to rotate between an open position (FIG. 4) and a closed position. The lever arm 48 comprises an end 50 rotating as a fork, a curved median portion of the hook type 52, and an end edge 54. The end rotating as a fork 50 is connected pivotally to the projecting end of the pin 40 by means of a peg 58. The pin 40 is anchored in the hole 34 (FIG. 4) which is present in the edge of the side wall 32*a*, and extends into the slit 32 and traverses the hole 36 of the edge of the side wall 32*b* projecting for a short distance beyond the cam surface 44. An eyelet is formed in the protruding end of the pin 40 to receive the peg 58 and to secure in a rotating manner the lever arm 48 to the protruding end of the pin 40. At its rotating end 50, the lever arm 48 is in the shape of an eccentric knuckle joint 62 positioned on the back and on the concave side of the lever arm 48, so that when the lever arm 48 rotates from an open position to a closed one, the knuckle joint 62 on the cam surface 44 pushes the edge of the side wall 32*b* towards the edge of the side wall 32*a* to grip the slit 32 and reduce the diameter or the cylindrical central hole 28: in this way the side wall 24 tightens around the upper tubular part 200 in order to force it to grip the intermediate tubular part 300, underlying said upper part 200, and prevents the respective sliding. The knuckle joint 62 is also formed in such a way that when the rotating arm 48 is moved a certain distance from an open position to a closed position, it triggers in a snap-type action towards the closed position.

The median portion 52 of the lever arm 48 is in the shape of a curved arm which has a thinner section 52*a* which touches and overlaps the cylindrical element 20 when the arm 48 is moved towards the closed position, and has a thicker section 52*b* which protrudes forwards from the thinner section 52*a* to touch and wrap around the end of the tubular parts 200 and 300 when the lever arm is in the closed position. A step 52*c* is formed between the thinner section 52*a* and the thicker section 52*b* of the central portion 52 and this step rests against one end of the cylindrical element 20 when the lever arm 48 is in the closed position.

The end part 54 of the lever arm 48 is formed so as to present a bevelled surface 54*a* staggered forwards with respect to the cylindrical element 20 when the lever arm 48 is in the closed position, to make it possible to move the lever arm from a closed position to one of opening by simply pushing against the bevelled surface 54*a*.

A spongy insert 70 (FIG. 4) may be placed in the slit 32 in order to extend partially into the central hole 28. The spongy insert 70 serves both to prevent the entry of water and/or of snow into the slit 32, and to prevent the end portion of the intermediate tubular part 300 from sliding outside of the end portion of the upper tubular part 200 when the clamp 10 is in the open position.

That is, without the spongy insert 70, when the clamp 10 is in the open position, the application of a very small pressure at the terminal end 6 of the upper tubular section 200, such as not to tighten said upper tubular part 200 around said lower tubular section 300, could lead said intermediate tubular section 300 to slide out of the upper tubular section 200.

What has been described hitherto for the device 10 is applicable to the device 10', even if, in one embodiment, it is possible that said devices 10, 10' are different one from the other but always suitable for keeping telescopic rods clamped one in respect of the other.

Numerous detail variations and changes can be made to the embodiment of the invention described above, within the reach of a person skilled in the art and in any case coming within the scope of the invention expressed by the annexed claims.

The invention claimed is:

1. A foldable telescopic stick (100), comprising:

locking elements (10, 10');

at least four tubular portions including an upper telescopic tubular part (200) provided with a grip (60), a first intermediate telescopic tubular part (300), a second intermediate telescopic tubular part (400), and a lower tubular part (500), said upper, first intermediate, and second intermediate telescopic parts (200, 300, 400) being slidable one in the other and fixable in position by the locking elements (10, 10'), said upper, first intermediate, and second intermediate telescopic parts (200, 300, 400) being i) retractable into a telescopically closed position of minimum extension, and ii) extendable into a fully extended position of maximum extension, the lower tubular part (500) being releasably and foldably connected to said second intermediate telescopic part (400) wherein the lower tubular part is extended into a fully extended position, and released from and folded with the second intermediate telescopic parts into a folded condition, a pointed end (1) terminating the lower tubular part (500);

a plug (4) located on an upper end of said first intermediate part (300), the plug including a hollow cylindrical seat;

a rope (2) extending from said lower tubular part (500) and internally traversing at least said second intermediate part (400) and said plug (4), said rope (2) restraining said lower tubular part (500) to the first intermediate and second intermediate telescopic parts (300, 400) so that said stick (100), when in said telescopically closed position, folds into two parts only, the two parts consisting of i) the telescopically closed upper, first intermediate, and second intermediate telescopic parts (200, 300, 400) in the position of minimum extension, and ii) said lower part (500), with the telescopically closed upper, first intermediate, and second intermediate telescopic parts (200, 300, 400) in the position of minimum extension being located adjacent to and alongside the lower part (500), the lower part (500) being released from the adjacent intermediate part (400); and a shank (3) restraining said rope (2) to said first intermediate part (300), the shank (3) slidable along the rope (2) which goes to abut in the hollow cylindrical seat of the plug (4) located on the upper end of said first intermediate part (300).

2. The stick according to claim 1 wherein one end of the rope (2) is restrained to said lower part (500).

3. The stick according to claim 1, wherein said plug (4) is inserted at the upper end of said first intermediate part (300).

4. The stick according to claim 1, wherein a length of the rope (2) is maintained constant by a knot which abuts on a rear part of said sliding shank (3).

5. The stick according to claim 1, wherein the upper tubular part (200) and the intermediate tubular portions (300, 400) are connected one to the other via said locking elements (10, 10').

6. The stick according to claim 1, further comprising:

a strap placed to the grip (60), the strap (61) suitable for favouring a more secure grasping of the stick (100), and an elastic band (62), inserted in the strap, suitable for being arranged around the two folded tubular portions of the stick in order to keep the two folded tubular portions together and compact when the stick is in the folded condition.

7. The stick according to claim 1, wherein said first intermediate telescopic part (300) is suitable for regulating an overall length of the stick (100) according to a height of a user when the upper tubular part (200) slides on the first intermediate telescopic part (300).

8. The stick according to claim 1, wherein the rope (2) is elastic.

9. The stick according to claim 1, wherein, the locking element (10, 10') is a clamp suitable for tightening around each cylindrical end portions of each two adjacent connecting tubular parts, the locking element (10, 10') comprising a resilient tubular element (20) having a side wall (24) which defines a longitudinal cylindrical hole (28) for receiving the cylindrical end portion, said side wall (24) provided with a slit (32) which extends longitudinally in order to allow the resilient tubular element (20) to be selectively distorted in order to reduce the amplitude of the slit (32) and therefore the diameter of the hole (28) or to enlarge the amplitude of the slit and therefore the diameter of the hole, said slit (32) defining a first and a second edge of opposite side walls (32*a*, 32*b*) having respectively a first coaxial opening (34) and a second coaxial opening (36), pin means (40) anchored at one end in the first opening (34) in order to extend with the other end through the second opening (36), and a lever arm (48) attached, in one of its ends, to the other end of the pin means (40) in a rotating manner, in order to move between a locking position of closure, wherein the lever arm (48) is in contact with the cylindrical end portion (4) in order to push the first and the second edge of the side walls (32*a*, 32*b*) one towards the other, and a position of non-closure wherein the lever arm (48) is rotated away from the cylindrical end portion (4) in order to allow the slit (32) to widen (32, 132), said second edge of the side wall (36) comprising a cam surface (44), and said lever arm (48) comprising an eccentric knuckle joint (62) formed at one of the ends of the lever arm in order to touch the cam surface (44) and force the second edge of the side wall towards the first edge of the side wall when the lever arm is rotated towards the locking position.

10. The stick according to claim 9, wherein said lever arm (48) comprises a thinner section (52*a*) which overlaps a portion of the side wall (24), and a thicker section (52*b*) which overlaps a portion of the cylindrical shaft which projects out from the cylindrical hole (28) of the resilient tubular element (20).

11. The stick according to claim 1, wherein said plug (4) is inserted at the upper end of said first intermediate part (300) and fixed with a peg.

12. A foldable telescopic stick (100), comprising:

locking elements (10, 10');

an upper telescopic tubular part (200), a first intermediate telescopic tubular part (300), and a second intermediate telescopic tubular part (400), that slide one in the other, and are fixable, by the locking elements (10, 10') in a telescopically closed position of minimum extension;

a lower tubular part (500) releasably and foldably connected to said second intermediate telescopic part (400);

a plug (4) located on an upper end of said first intermediate part (300), the plug including a seat;

a rope (2) extending from said lower tubular part (500) and traversing said first and second intermediate parts (200, 400) and said plug (4), said rope (2) restraining said lower tubular part (500) to the first and second intermediate telescopic parts (200, 300, 400) so that said stick (100) folds into two parts only, the two parts consisting of i) the upper, first intermediate, and second intermediate telescopic parts (200, 300, 400) in the telescopically closed position of minimum extension, and ii) said lower part (500) in a folded condition, with the upper, first intermediate, and second intermediate telescopic parts (200, 300, 400) in the telescopically closed position of minimum extension being located adjacent to and alongside the lower part (500); and a shank (3) restraining said rope (2) to said first intermediate part (300), the shank (3) slidable along the rope (2) and abutable against the seat of the plug (4).

* * * * *